US006116337A

United States Patent [19]

Civarolo et al.

[11] Patent Number: 6,116,337

[45] Date of Patent: Sep. 12, 2000

[54] ARTICULATED DOWNHOLE ELECTRICAL ISOLATION JOINT

[75] Inventors: Marcelo F. Civarolo, Katy; Wade D. Dupree, Richmond, both of Tex.

[73] Assignee: Western Atlas International, Inc., Houston, Tex.

[21] Appl. No.: 09/098,992

[22] Filed: Jun. 17, 1998

[51] Int. Cl.[7] ..... E21B 17/20; H01R 24/02

[52] U.S. Cl. ..... 166/65.1; 166/242.6; 439/194; 439/195

[58] Field of Search ..... 166/65.1, 254.2, 166/242.6; 439/195, 194, 193, 192, 191

[56] References Cited

U.S. PATENT DOCUMENTS 5,159,978 11/1992 Tomek et al. ..... 166/254.2
5,836,388 11/1998 Tchakarov ..... 166/242.6
5,927,402 7/1999 Benson et al. ..... 439/194

FOREIGN PATENT DOCUMENTS 094023176 10/1994 WIPO ..... 166/65.1

*Primary Examiner*—William Neuder
*Attorney, Agent, or Firm*—Darryl M. Springs

[57] ABSTRACT

An articulated connector for providing electrical insulation between downhole well equipment such as logging sondes suspended by a wireline. Articulated joints are connected to the well equipment to provide for the desired movement, and the joints are connected by a central housing. The housing is configured so that a nonconductive element interrupts electrical conductivity through metallic components of the housing. The housing uniquely combines with the articulated joints to provide an articulated connection between the well equipment while providing electrical insulation therebetween.

20 Claims, 3 Drawing Sheets

19
18
12
10
16
14
15

ARTICULATED DOWNHOLE ELECTRICAL ISOLATION JOINT

BACKGROUND OF THE INVENTION

The present invention relates to an apparatus for connecting equipment in a well. More particularly, the present invention relates to an apparatus for electrically insulating well logging instruments while permitting articulated movement therebetween.

Wireline logging instruments known as logging sondes are lowered into wells to detect data related to the physical parameters and conditions in a well. Two or more sondes or sonde sections are typically positioned in offset lateral positions within the well, and are connected by articulated joints. Wires for providing power and control signals are connected to each sonde, and these wires require electrical interconnections between the sondes and the articulated joints. These electrical interconnections increase the overall length and cost of the sonde assemblies and introduce potential failure points at each electrical connection within the sonde assemblies.

Logging sondes are typically constructed with metallic housings and must be electrically insulated to reduce the impact of uncontrolled electrical signals and currents. In particular, adjacent sondes must be electrically insulated to prevent electrical signals or current from migrating from one sonde to another. This electrical insulation is typically accomplished with devices called mass isolators which are constructed with ceramic or fiberglass barriers to isolate adjacent metallic components. Articulated joints are connected between the logging sondes to permit articulated movement between the respective sondes.

The combined sonde assemblies containing mass isolators, electrical interconnections, and articulated joints are cumbersome, difficult to maintain, and contain numerous components that increase the difficulty and cost of manufacture. Accordingly, a need exists for an improved apparatus that permits the articulated connection of well logging instruments while preventing electrical conductivity therebetween.

SUMMARY OF THE INVENTION

The present invention provides an articulated connector for connecting and electrically insulating first and second downhole elements. A first joint is connected to the first element, and a second joint is connected to the second element. A housing is connected to the first and second joints so that said first joint articulates the housing relative to the first downhole element, and the second joint articulates the housing relative to the second downhole element. The housing electrically insulates the first downhole element from the second downhole element.

In other embodiments of the invention, the downhole elements can comprise logging instruments such as logging sondes. A wire for transmitting power or signals can be positioned through the housing or a sleeve within the housing, and a pressure balance system can maintain a constant pressure within the housing.

DESCRIPTION OF THE PREFERRED EMBODIMENTS

Figure 1:
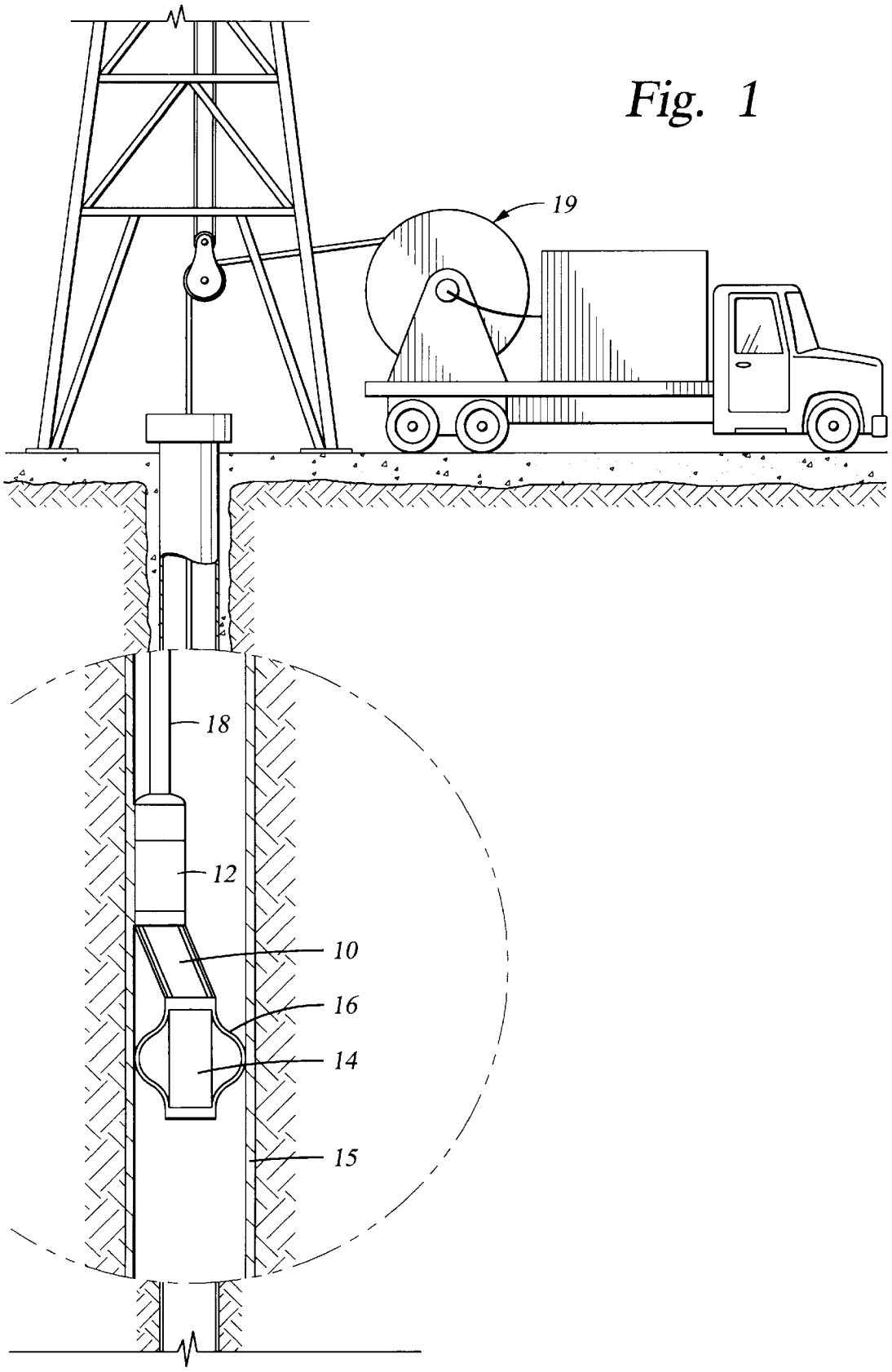
FIG. 1 illustrates the use of the invention between two logging sondes downhole in a well.

As illustrated in FIG. 1, the present invention is positioned between logging sondes in a well. Apparatus 10 is located between sonde 12 and sonde 14 in well 15. Centralizer 16 is connected to sonde 14 and retains sonde 14 proximate to the center of well 15. Centralizer 16 maintains this position regardless of the vertical or horizontal orientation of well 15. It is not essential to position certain sondes such as sonde 12 in the center of well 15, however the different alignment between sonde 12 and sonde 14 inherently requires a mechanism for accommodating offset and other relative movement.

Line 18, which can comprise tubing or a wireline as known in the art, is attached to sonde 12 and is operated from wireline reel 19. Line 18 can be reeled in or paid out by reel 19 to raise and lower sondes 12 and 14 within well 15. As shown in FIG. 1, sondes 12 and 14 are frequently positioned at a lateral offset in well 15. The offset dimension is measured as the distance between the parallel axes of sonde 12 and of sonde 14.

Figure 2:
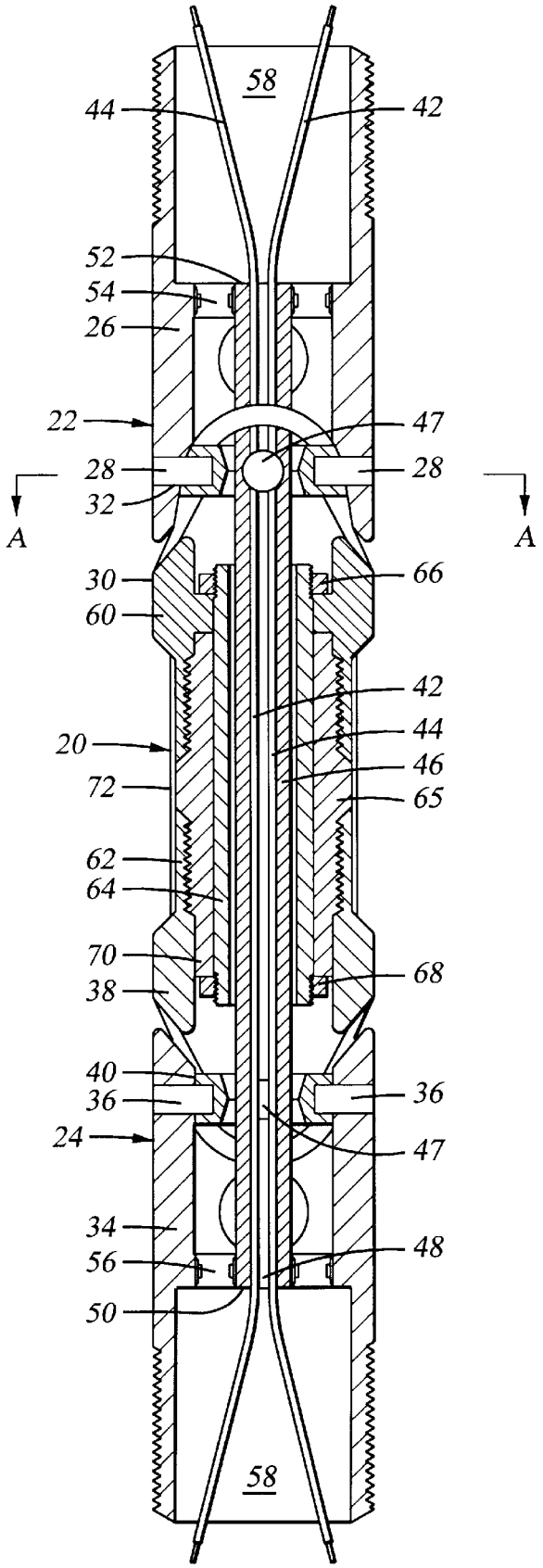
FIG. 2 illustrates a sectional view of the invention positioned between two logging sondes.

FIG. 2 illustrates a sectional view of the invention and more particularly describes the features of apparatus 10. Housing 20 is positioned between articulated joints 22 and 24. Articulated joint 22 is illustrated as a knuckle or clevis type joint comprised of joint body 26 and pins 28 which are aligned along a common center axis. Pins 28 are engaged with first end 30 of housing 20 through pin housing 32. First end 30 is formed as a clevis and cooperates with pins 28 to permit two dimensional movement of housing 20 about pins 28.

Articulated joint 24 is similarly illustrated as a knuckle or clevis type joint comprised of joint body 34 and pins 36 aligned along a common axis. Pins 36 are engaged with second end 38 of housing 20 of pin housing 40. Second end 38 is formed as a clevis and cooperates with pins 36 to permit two dimensional movement of housing 20 about pins 36.

Figure 3:
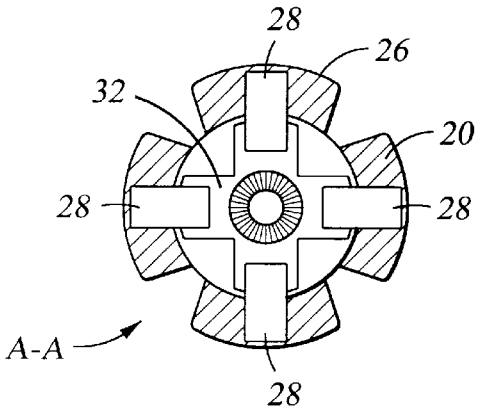
FIG. 3 illustrates a cross-sectional view of an articulated joint.

Joints 22 and 24 could be configured in numerous ways adequate to provide two dimensional or three dimensional movement. In the embodiment illustrated in FIGS. 1 and 2, joints 22 and 24 are illustrated as a double knuckle joint or universal joint combination wherein sondes 12 and 14 can be laterally offset without permitting axial rotation of sondes 12 and 14. Crossectional detail of joint 22 is illustrated in FIG. 3. The configuration and operation of joints 22 and 24 can be modified to meet the particular requirements of vertical wells such as well 16, or to meet the requirements of highly deviated wells such as lateral or horizontal wells.

Referring to FIG. 2, power wire 42 and control wire 44 extend through sleeve 46 between sonde 12 and sonde 14. Power wire 42 can transmit electric power to sonde 14 or to other equipment (not shown) in well 16. Control wire 44 can transmit electric or optical signals and impulses to sonde 14 or to other equipment. In a preferred embodiment of the invention, sleeve 46 is constructed as a single flexible component from a high temperature resistant material such as Teflon or a convoluted metal hose. In this embodiment, sleeve 46 will elastically deform with the angular movement of housing 20 relative to joints 22 and 24. In another embodiment of sleeve 46, articulated joints such as connectors 47 can be positioned integrally with sleeve 46 to provide the necessary flexibility proximate to joints 22 and 24. In another embodiment, flexible material sections could be integrated within sleeve 46 proximate to joints 22 and 24 to provide the requisite movement.

Sleeve 46 forms hollow core 48 and includes apertures 50 and 52 exposed to the interior of sondes 12 and 14. Although power wire 42 and control wire 44 are shown in FIG. 2, numerous wires could be routed through sleeve 46 to perform different functions. Seals 54 and 56 prevent fluid migration into sondes 12 and 14 and into the respective apertures 50 and 52. As shown in FIG. 2, fluid such as oil 58 can fill the interiors of sondes 12 and 14 and core 48 of sleeve 46. In this embodiment of the invention, seals 54 and 56 can prevent leakage and contamination of oil 58.

In one embodiment of the invention, the pressure of oil 58 can be pressure balanced with a pressure compensation system integrated within seals 54 and 56. The pressure of oil 58 can be pressure balanced with floating pistons, bellows, and other techniques known in the art.

Housing 20 uniquely provides different functions by providing electrical insulation between joints 22 and 24 while providing an articulated mechanical connection therebetween. Housing 20 is sufficiently strong to handle the compressive and tensile loads acting between sonde 12 and sonde 14. The length of housing 20 can be selected to provide the desired lateral displacement between sondes 12 and 14, and to provide the desired distance between adjacent sondes 12 and 14. As representative examples, the lateral displacement can range between one and eighteen inches, and the isolation length between sondes 12 and 14 can range between six and one hundred inches. It will be appreciated that these dimensions are merely representative and can be extended or shortened to meet particular applications of the present invention.

One embodiment of housing 20 is illustrated in FIG. 2 as a mass isolator having the capability of electrically insulating joints 22 and 24. Housing 20 generally includes first section 60, second section 62, and inner cylinder 64. Insulator 65 is positioned between first section 60, second section 62, and inner cylinder 64 to prevent electrical conductivity therebetween. Insulator 65 can comprise a separate component to facilitate assembly as illustrated in FIG. 2 or can be integrated with inner cylinder 64 into a single component. Cylinder 64 can be retained to first section 60 by a threaded engagement engaged with nut 66 as illustrated, and cylinder 64 can be retained to second section 62 by a threaded engagement engaged with nut 68. Insulating sleeve 70 is positioned between second section 62 and cylinder 64 to prevent contact therebetween and to provide electrical insulation between such components. Outer sleeve 72 covers first section 60 and second section 62 to prevent wellbore fluids from entering housing 20. Outer sleeve 72 can be formed from a nonconducting material such as fiberglass or an epoxy composite to prevent electrical current flow between the outer surfaces of first section 60 and second section 62. This embodiment of housing 20 isolates first section 60 from second section 62 and prevents electrical conductivity therebetween.

Housing 20 can be constructed from synthetic or metallic materials or combinations of both. For example, housing 20 could be constructed from a substantally rigid high strength corrosion resistant steel alloy, and could be coated with a composite material.

Figure 4:
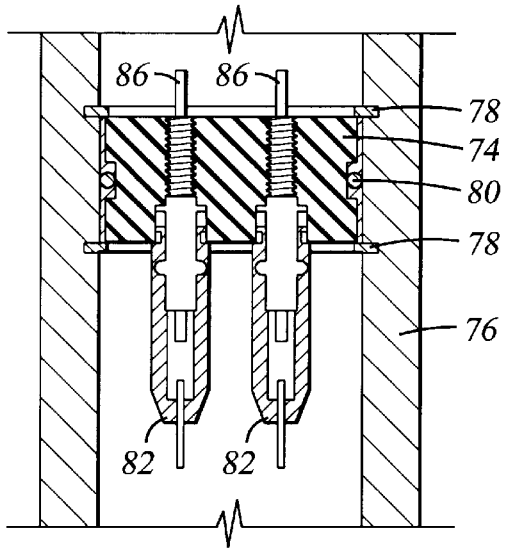
FIG. 4 illustrates a pressure bulkhead for securing electrical wires without permitting the passage of fluid therethrough.

Referring to FIG. 4, an alternative embodiment of the present invention is shown wherein electrical wires are retained without a protective conduit such as sleeve 46. Pressure bulkhead 74 is positioned within joint housing 76 and is retained with rings 78. Seal 80 prevents the migration of fluid between bulkhead 74 and housing 76. Boots 82 are engaged with apertures 84 and permit wires 86 to penetrate bulkhead 74 without fluid leakage therethrough. Wires 86 extend from bulkhead 74, through a mass isolator such as that shown in shown at housing 20 in FIG. 2, and to another bulkhead (not shown) associated with a joint housing similar to joint housing 76. In this embodiment of the invention, wires 86 are in contact with the well fluids between the respective bulkheads, and the flexibility of wires 86 accommodates flexure of the respective sondes, articulated joints and connected housing.

Figure 5:
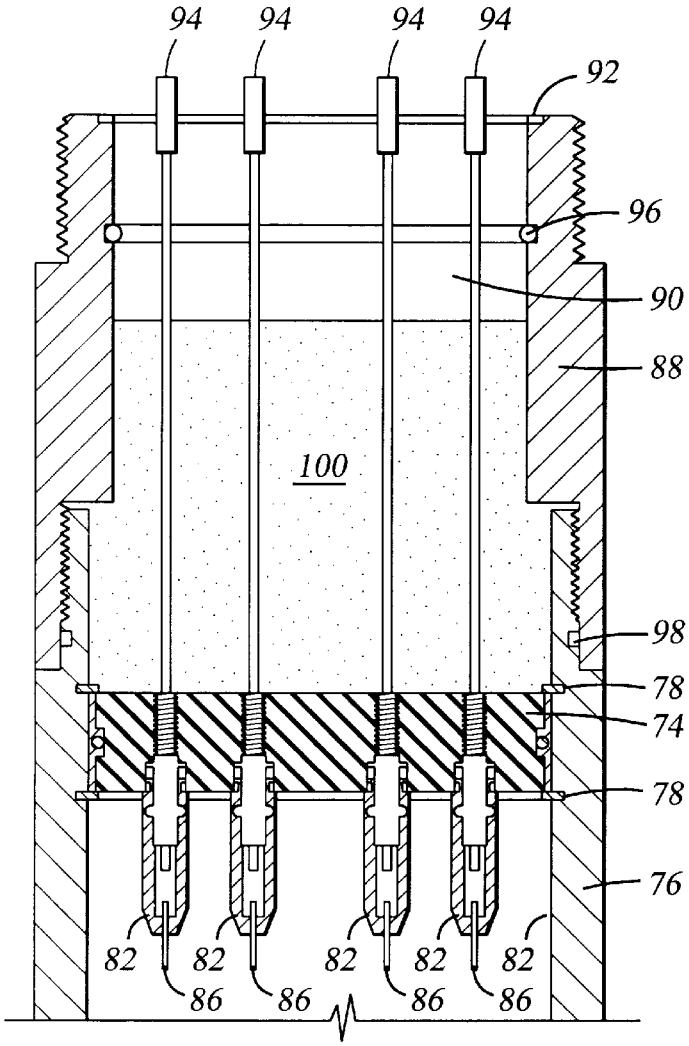
FIG. 5 illustrates one embodiment of the invention wherein the electrical connections are protected from the ambient well conditions.

The embodiment shown in FIG. 4 can be incorporated into another embodiment of the invention illustrated in FIG. 5, wherein bulkhead 74 is integrated within joint housing 76, which in turn is attached to connector housing 88. Electrical plug 90 is attached to connector housing 88 with ring 92 and includes pins 94 engaged with wires 86. Pins 94 are configured to mate with pin receptacles on an adjacent sonde or other type of equipment (not shown). Seal 96 prevents fluids from migrating between plug 90 and connector housing 88. Seal 98 can similarly prevent the migration of fluid between joint housing 76 and connector housing 88. Oil 100 can be placed around wires 86 in the interior space between bulkhead 74 and plug 90 to prevent deterioration of wires 86. This embodiment of the invention is useful when the logging sonde or other equipment is fully self contained and has an integral electrical connection for linkage with other electrical components.

The present invention reduces the cost of connecting logging sondes and other equipment by substantially reducing the number of components required to make such a connection. The invention increases the reliability of the system and reduces maintenance costs accordingly. Significantly, the invention reduces the number of electrical connections necessary to attach logging equipment, such as logging sondes, while permitting relative movement therebetween. This unique feature significantly reduces the possibility of system failure by providing an apparatus that reduces the failure points and protects the electrical wires. While the wires illustrated are shown as being capable of transmitting electrical current, other wires or lines such as optical lines or cables could be substituted for the electrical wires. In addition to the advantages described above, the invention shortens the required length of the assembly and enhances the operability in different well conditions.

Although the invention has been described in term of certain preferred embodiments, it will be apparent to those of ordinary skill in the art that modifications and improvements can be made to the inventive concepts herein without departing from the scope of the invention. The embodiments shown herein are merely illustrative of the inventive concepts and should not be interpreted as limiting the scope of the invention.

What is claimed is:

1. An articulate connector for retaining and electrically insulating first and second downhole elements, comprising:

a first joint connected to the first element;

a second joint connected to the second element;

a substantially rigid housing attached to said first and second joints so that said first joint articulates said housing relative to said first downhole element and said second joint articulates said housing relative to said second downhole element, and wherein said housing, electrically insulates the first downhole element from the second downhole element.

2. A connector as recited in claim 1, wherein said downhole elements comprise logging instruments.

3. A connector as recited in claim 1, further comprising a wire within said housing between the first downhole element and the second downhole element.

4. A connector as recited in claim 3, further comprising a sleeve within said housing for enclosing said wire.

5. A connector as recited in claim 3, wherein said wire is capable of transmitting electrical current.

6. A connector as recited in claim 1, further comprising a seal for preventing the flow of fluids through said housing.

7. A connector as recited in claim 6, further comprising a pressure balance system for maintaining a constant pressure within said housing.

8. A connector as recited in claim 1, wherein said first and second downhole elements comprise logging sondes.

9. An articulated connector for retaining and electrically insulating first and second logging instruments in a well, comprising:

a first joint connected to the first logging element;

a second joint connected to the second logging element;

a substantially rigid housing having a first end attached to said first joint for articulated movement relative to the first logging element and having a second end attached to said second joint for articulated movement relative to the second logging element; and an insulated attached to said housing for electrically insulating the first logging instrument from the second logging element.

10. A connector as recited in claim 9, further comprising a wire substantially enclosed by said housing between the first logging instrument and the second logging instrument.

11. A connector as recited in claim 10, further comprising a sleeve within said housing for substantially enclosing said wire.

12. A connector as recited in claim 11, wherein said sleeve is sufficiently flexible to accommodate movement of said housing relative to said first and second joints.

13. A connector as recited in claim 11, wherein said sleeve is comprised of a substantially rigid section having flexible sections adjacent said first and second joints.

14. A connector as recited in claim 11, further comprising articulated joints connected to said sleeve adjacent said first and second joints.

15. A connector as recited in claim 9, further comprising a seal to prevent the fluid flow through said housing.

16. A connector as recited in claim 9, further comprising a pressure balance system for maintaining a constant pressure within said housing.

17. A connector as recited in claim 16, further comprising a sleeve enclosed by said housing and having an interior core in contact with said pressure balance system.

18. A connectors as recited in claim 9, further comprising a first plug attached to said first joint and being adapted for engagement with said first logging instrument, a second plug attached to said second joint and being adapted for engagement with second logging instrument, and a wire between said first and second plugs.

19. A connector as recited in claim 18, wherein said plugs are electrical plugs, and wherein said wire communicates electrical current between said first and second logging instruments.

20. A connector as recited in claim 18, further comprising a first seal for isolating s a id first plug from a pressure in the well, and comprising a second seal for isolating the second plug from said pressure in the well.

* * * * *